United States Patent [19]

Tsai

[11] Patent Number: 4,858,504

[45] Date of Patent: Aug. 22, 1989

[54] SCREWDRIVER WITH INSULATED SHAFT AND POLYGONAL DRIVING HEAD

[76] Inventor: Jame Tsai, No. 331, Ren Shin Rd., Wu Lin Tsuen, Ren Wu Shiang, Kaohsiung, Taiwan

[21] Appl. No.: 227,086

[22] Filed: Aug. 1, 1988

[51] Int. Cl.[4] ..... B25B 15/00

[52] U.S. Cl. ..... 81/436; 81/58.1; 81/177.2; 81/463

[58] Field of Search ..... 81/177.2, 58.1, 436, 81/463

[56] References Cited

U.S. PATENT DOCUMENTS

| | | | |
|---|---|---|---|
| 2,672,066 | 3/1954 | Sandrock et al. | 81/177.2 X |
| 3,343,577 | 9/1967 | Wagner | 81/436 X |
| 4,212,336 | 7/1980 | Smith | 81/177.2 X |
| 4,437,365 | 3/1984 | Taari | 81/436 |
| 4,541,314 | 9/1985 | Korkowski | 81/58.1 |

*Primary Examiner*—James G. Smith

*Attorney, Agent, or Firm*—Bernard R. Gans

[57] ABSTRACT

A screwdriver with insulated shaft and polygonal driving head comprising an insulated block disposed between a shaft and a polygonal head. A handle of insulated material is engaged on the shaft, so that the screwdriver accordingly is insulated and an operator of the screwdriver can be protected from electric shock.

1 Claim, 5 Drawing Sheets

SCREWDRIVER WITH INSULATED SHAFT AND POLYGONAL DRIVING HEAD

BACKGROUND OF THE INVENTION

The present invention relates to a screwdriver with insulated shaft and polygonal head which pass through the handle of the screwdriver used to release screws, bolts, etc.

A conventional screwdriver comprises a shaft with one end engaging with the lower end of a handle. The other end of the shaft forming a phillips blade or a flat blade. Such screwdriver can not be driven by a wrench for applying an axial pressure or torque. Korkowski proposed in U.S. Pat. No. 4,541,314 a power driven hand tool which can mate with and be driven by a ratchet mechanism. However, such tool would be easily cracked at the handle-shaft engaging point if used in conjunction with a hammer as a chisel-device. In further developement, the shaft was designed to pass through the handle. In this case, if a screw desired to be loosened came in contacts with a live wire, an operator using such a screwdriver to loosen the screw would get a shock.

It is the purpose of the present invention, therefore, to mitigate and/or obviate the above-mentioned drawbacks in the manner set forth in the detailed description of the preferred embodiment.

SUMMARY OF THE INVENTION

It is a primary objective of the present invention to provide a screwdriver with a shaft passing through a handle of the screwdriver for use in conjunction with a hammer to function as a chisel-like device.

It is another objective of the present invention to provide a screwdriver in which an insulated block is arranged in the shaft so that an operator is protected from electric shock.

Further objectives and advantages of the present invention will become apparent as the following description proceeds, and the features of novelty which characterize the present invention are pointed out with particularity in the claims annexed to and forming a part of this invention.

DETAILED DESCRIPTION OF THE PREFERRED EMBODIMENT

Figure 1:
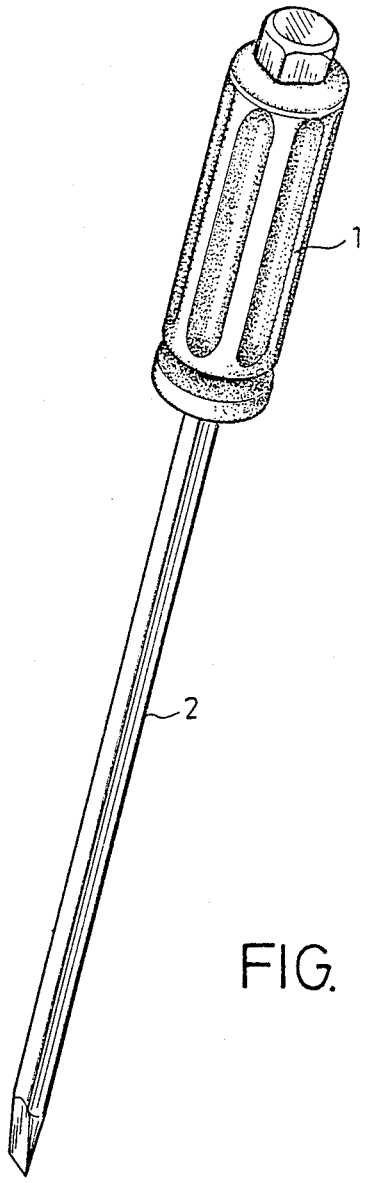
FIG. 1 is a perspective view of a screwdriver according to the present invention.
Figure 2:
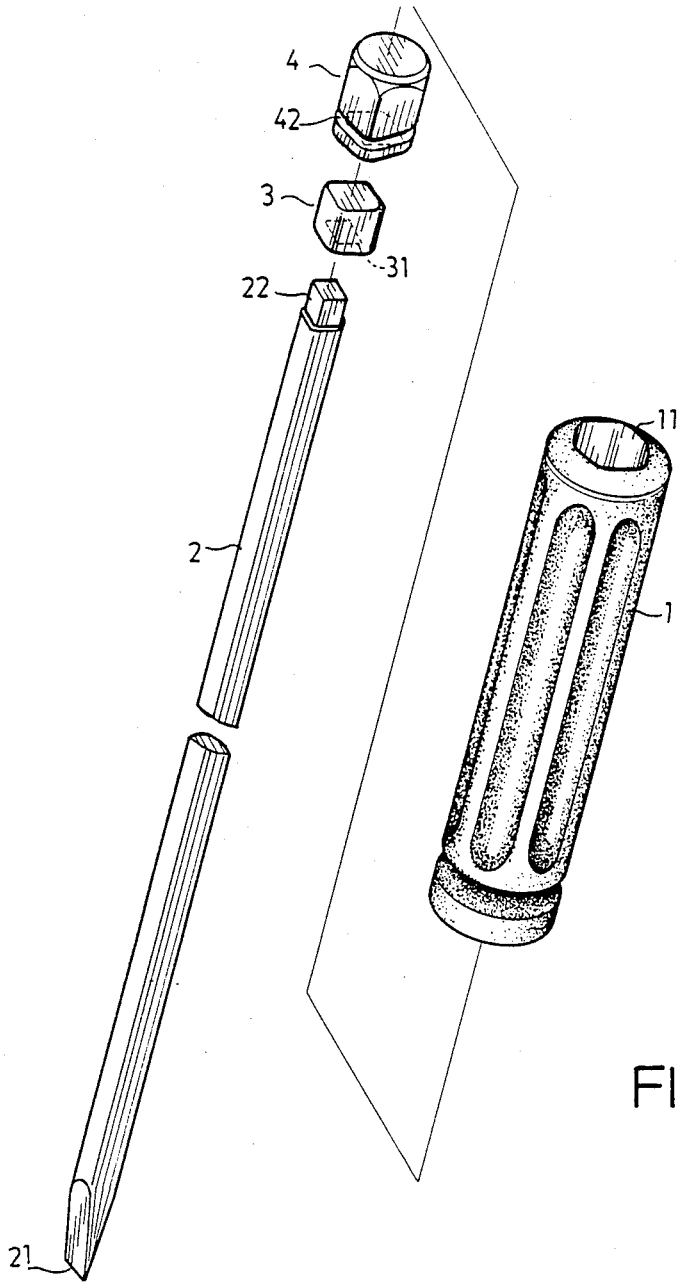
FIG. 2 is an exploded view of the screwdriver shown in FIG. 1.
Figure 3:
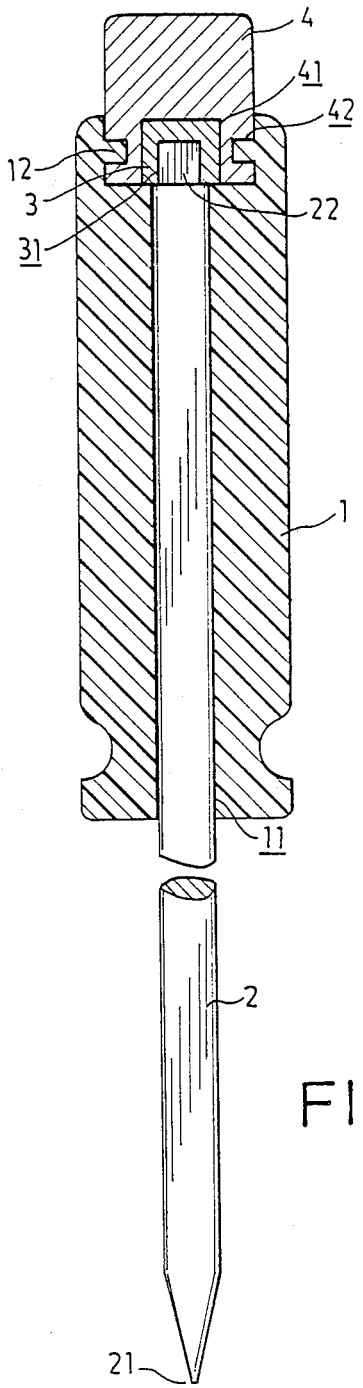
FIG. 3 is a cross-sectional view showing an insulated block disposed in the screwdriver.

Referring to FIGS. 1 to 3, a screwdriver according to the present invention comprises a handle 1, a shaft 2, an insulated block 3 and a polygonal head 4. The shaft 2 has a blade end 21 which may be phillips or flat shape (FIGS. 1 to 3 only show the phillips shaped blade). The other end 22 of the shaft 2 is a polygonal shape. The insulated block 3 is also a polygonal block, which comprises a polygonal recess 31 to receive the polygonal head 22 of the shaft 2. The polygonal head 4 comprises a polygonal recess 41 to receive the insulated block 3 and a slot 42 on the perimeter thereof. The handle 1 has a centrally axial cylindrical opening 11 to receive the shaft 2 insulated block 3 and polygonal head 4. However, the upper portion of the polygonal head 4 and the lower portion of the shaft 2 respectively extend out of the ends of the handle 1. The handle 1 further comprises a flange 12 projecting from the inner periphery of the opening 11 in order to engage with the slot 42 of the polygonal head 4. The handle 1 and the insulated block 4 are made of insulated material.

When assemblying, the insulated block 3 is mounted on the polygonal head 22 of the shaft 2, then, the polygonal head 4 is mounted on the insulated block 3. Finally, the handle 1 is injection moulded onto the above-mentioned elements.

Figure 4:
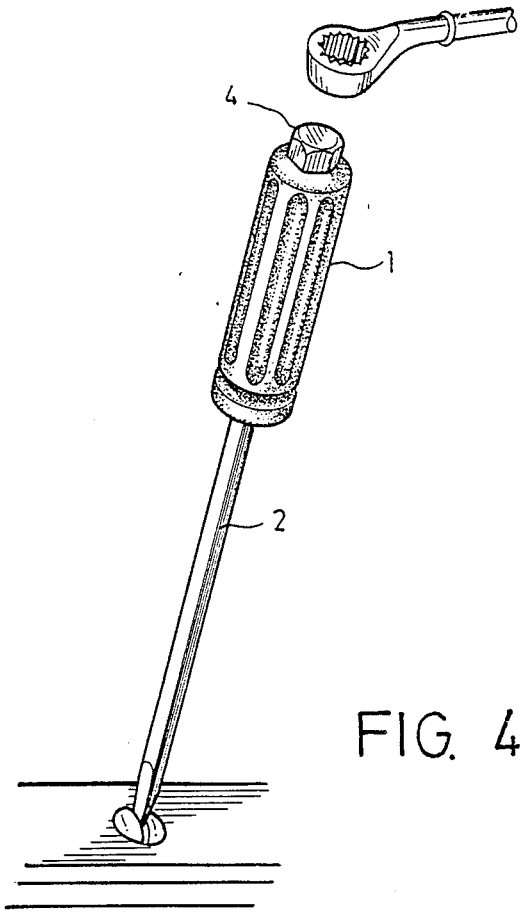
FIG. 4 is a perspective view showing the screwdriver used with a wrench.

Since there is an insulated block 3 disposed between the shaft 2 and the polygonal head 4, an operator will not be hurt by electric shock when the operator uses a wrench made of metal to drive the screwdriver, as shown in FIG. 4.

Figure 5:
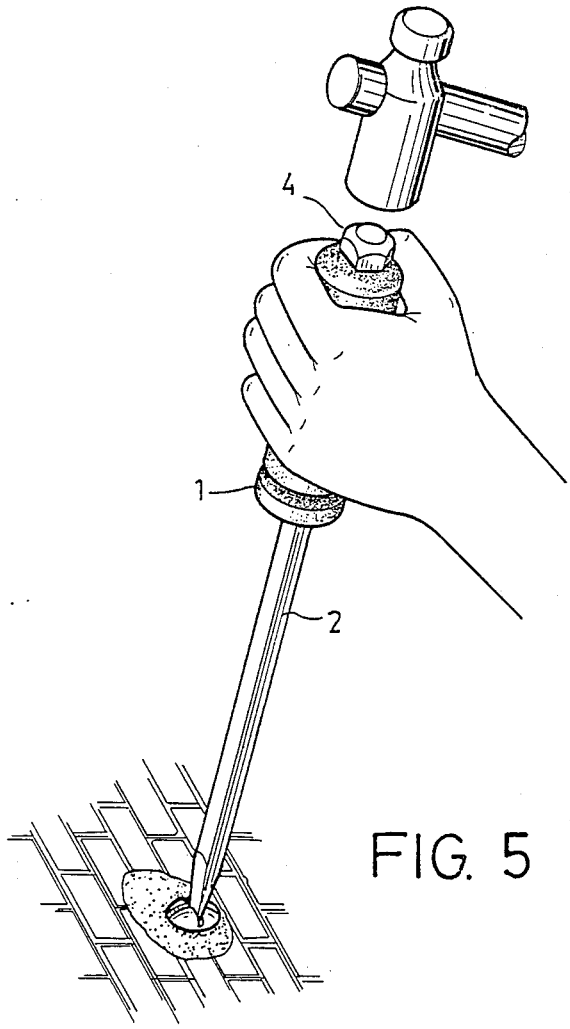
FIG. 5 is a perspective view showing the screwdriver used with a hammer.

As can be seen in FIG. 5, the screwdriver of the present invention can be used together with a hammer as a chisel-device. It is appreciated that the impact of the hammer axially passes through the screwdriver for loosening a screw or a bolt.

From FIG. 4, it can be seen that the polygonal head 4 protruding from the handle 1 is easily engageable with a corresponding wrench to facilitate applying axial pressure or torgue to screws or bolts.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A screwdriver with insulated shaft and polygonal driving head comprising:

a shaft with a blade end and a polygonal end;

an insulated block having a polygonal recess which receives said polygonal end of said shaft;

a polygonal head having a polygonal recess which receives said insulated block and a slot on the perimeter of said polygonal head; and a handle having a centrally axial essentially cylindrical opening to receive said shaft, insulated block and polygonal head and a flange to engage with said slot of said polygonal head; an upper portion of said polygonal head and a lower portion of said shaft, respectively, extending from said opening of said handle.

* * * * *